United States Patent [19]

Hutchinson

[11] Patent Number: 4,891,029

[45] Date of Patent: Jan. 2, 1990

[54] REMOTE CONTROL LIGHTER-THAN-AIR TOY

[76] Inventor: Jack M. Hutchinson, Rte. 3, Box 667B, Shawnee St., Bay St. Louis, Miss. 39520

[21] Appl. No.: 242,638

[22] Filed: Sep. 12, 1988

Related U.S. Application Data

[63] Continuation-in-part of Ser. No. 12,314, Feb. 9, 1987, Pat. No. 4,799,914.

[51] Int. Cl.[4] ..... A63H 27/00; A63H 3/06; A63H 29/22; B64D 27/00

[52] U.S. Cl. ..... 446/58; 446/225; 446/484; 244/56; 244/198; 320/2

[58] Field of Search ..... 446/58, 34, 57, 225, 446/236, 232, 226, 484, 33; 244/24, 29, 30, 26, 56, 189, 190; 320/2

[56] References Cited

U.S. PATENT DOCUMENTS

| | | | |
|---|---|---|---|
| 1,726,062 | 8/1929 | Gilman | 244/56 X |
| 2,081,381 | 5/1937 | Oehmichen | 244/26 X |
| 2,876,410 | 3/1959 | Fry | 320/2 X |
| 3,117,384 | 1/1964 | Billis | 446/901 X |
| 3,145,404 | 8/1964 | Fiedler | 320/2 X |
| 3,229,421 | 1/1966 | Ostrander | 446/484 X |
| 3,533,119 | 10/1970 | Dokos | 320/2 X |
| 4,145,838 | 3/1979 | Mason | 446/225 X |
| 4,204,656 | 5/1980 | Seward | 224/190 X |
| 4,408,412 | 10/1983 | Forker | 446/225 |
| 4,563,626 | 1/1986 | Ohtake | 446/462 X |
| 4,722,713 | 2/1988 | Williams et al. | 446/901 X |
| 4,743,735 | 5/1988 | Abura et al. | 320/2 X |
| 4,799,914 | 1/1989 | Hutchinson | 446/33 X |

FOREIGN PATENT DOCUMENTS

| | | | |
|---|---|---|---|
| 2733708 | 2/1979 | Fed. Rep. of Germany | 446/901 |
| 2805069 | 8/1979 | Fed. Rep. of Germany | 446/34 |
| 2397976 | 3/1979 | France | 224/24 |
| 2520939 | 8/1983 | France | 446/462 |

*Primary Examiner*—Robert A. Hafer
*Assistant Examiner*—D. Neal Muir
*Attorney, Agent, or Firm*—William M. Hobby, III

[57] ABSTRACT

A remote control lighter-than-air toy apparatus has an inflatable container having a predetermined shape, such as the shape of a dirigible, for holding a lighter-than-air gas. A gondola is removably attached to the inflatable container and has a shaft extending therethrough and rotatably supported thereon. A reversible electric motor is attached to each end portion of the shaft passing through the gondola with each electric motor having a propeller attached thereto for rotation upon actuation of the electric motor. Each of the electric motors and propellers are rotatably attached to the shaft. A radio receiver is connected to each of the electric motors with a plurality of conductors. A control box has a radio transmitter therein and a plurality of controls thereon for transmitting to said receiver and remotely controlling each motor separately, so that a lighter than air toy can be remotely controlled with two propellers.

5 Claims, 1 Drawing Sheet

REMOTE CONTROL LIGHER-THAN-AIR TOY

BACKGROUND OF THE INVENTION

The present invention relates to toys and especially to lighter-than-air toys having motorized propellers attached thereto and remotely controlled. This application is a continuation in part of my prior U.S. patent application Ser. No. 012,314 for REMOTE CONTROL LIGHTER THAN AIR TOY, filed 02/09/1987, now U.S. Pat. No. 4,799,914.

In the past, there has been wide use of dirigibles, which are lighter-than-air aircraft, that are filled with lighter-than-air gasses, such as helium. A typical dirigible has a bullet shape with a gondola attached to the bottom with motor driven propellers for controlling the movement of the dirigible. It has also been suggested in the past to fill balloons and other containers with lighter-than-gas air. Sometimes these are on tether lines for preventing their loss. Other lighter-than-air toys can be seen in the Goldfarb U.S. Pat. No. 3,225,488 and in the Winker U.S. Pat. No. 4,125,233 which Patents show toy blimps tethered from the ground. The Wolfe U.S. Pat. No. 3,292,304 shows a toy spaceship filled with a lighter-than-air gas and having three separate electrically driven propellers for controlling the toy in several directions from a console on the ground. The Propellers are driven by reversible electric motors.

In contrast to these prior patents, the present invention has a blimp shape similar to the prior dirigibles and dirigible looking toys and is remotely controlled, but provides two propellers which, in addition to being forward and reversibly driven, can be rotated on the shaft attached to the gondola. The gondola can be removably attached to a lighter-than-air container for a rapid changing of the gondola from one lighter-than-air container to another.

SUMMARY OF THE INVENTION

The present invention relates to a remote control lighter-than-air toy having an inflatable container having a predetermined shape for holding a lighter-than-air gas. A gondola is removably attached to the inflatable container, such as with hook and loop material on one side of the gondola and on the flexible container, or alternatively, with an adhesive that allows the gondola to be removed. A shaft extends through the gondola and is rotatably supported thereon in sleeves mounted thereto. A reversible electric motor is attached to each end portion of each shaft and has a propeller attached thereto for rotation upon actuation of the electric motor. Each of the electric motors and propellers are rotatably attached to the shaft for adjusting the position of the propeller for gaining additional control. A third electric motor may be mounted in the gondola for remote control of the rotation of the shaft. A radio receiver is connected to each of the electric motors with a plurality of conductors. A control box has a radio transmitter therein and a plurality of controls thereon for transmitting to the receiver and remotely controlling each motor separately, so that a lighter than air toy can be remotely controlled with two propellers from a remote transmitter. A battery pack is placed in the gondola and is connected to the radio receiver with electrical conductors and to said electric motors for powering said radio receiver and electric motors. A battery charger may be positioned in the gondola for charging the batteries and may have an electric plug prongs for attaching to an electric receptacle for charging the batteries. The gondola may have a removable portion held with hook and loop fasteners which can be removed to place the battery charger plug prongs in position for insertion into an AC receptacle for recharging the batteries.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
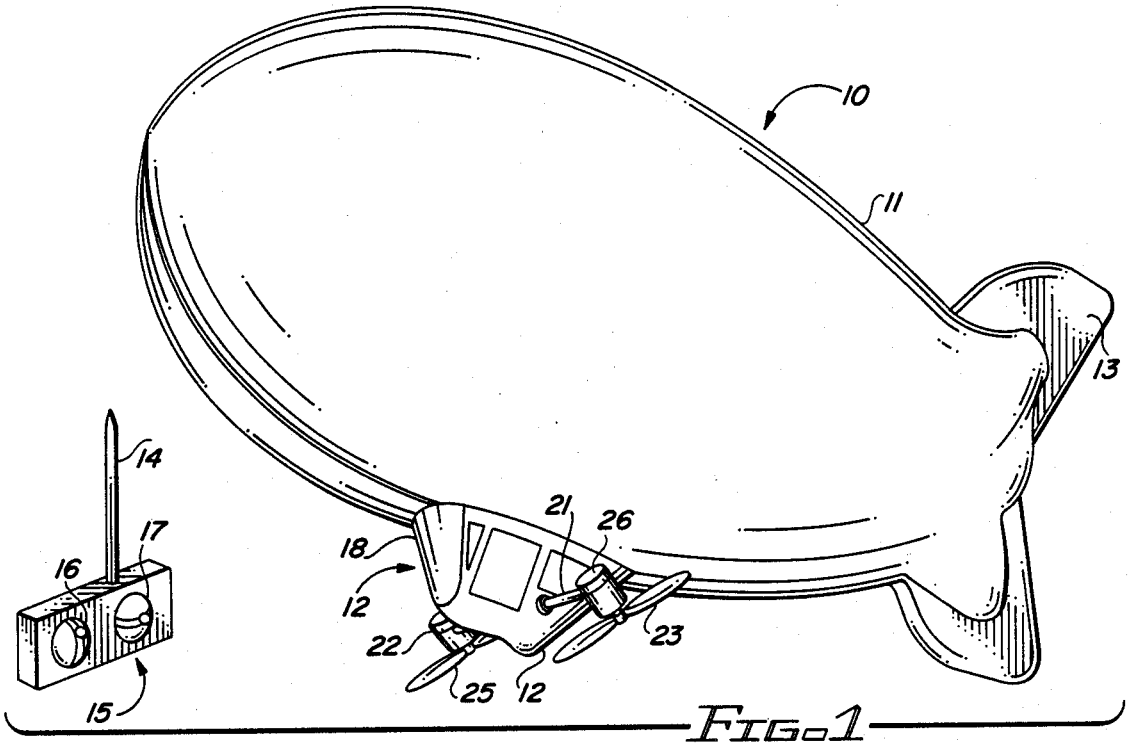
FIG. 1 is a perspective view of a remote controlled lighter-than-air toy.
Figure 2:
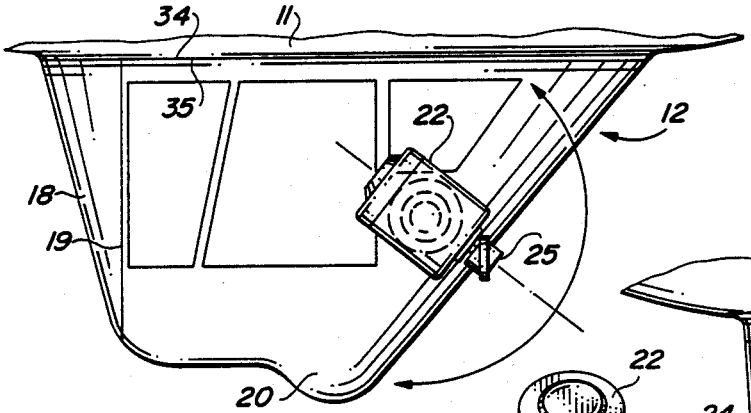
FIG. 2 is a side elevation of a gondola attached to the lighter-than-air toy of FIG. 1.
Figure 3:
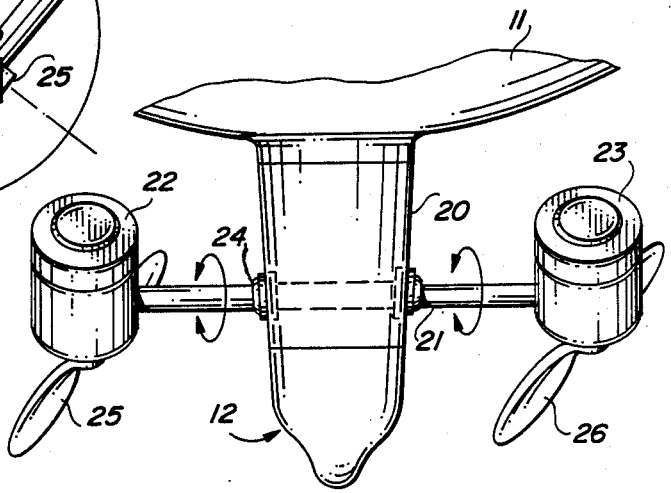
FIG. 3 is a front partial sectional view of a gondola in accordance with FIGS. 1 and 2.

Referring to the drawings, a lighter-than-air toy 10 is illustrated having an inflatable bag or lighter-than-air container 11 shaped in this case like a dirigible but of greatly reduced size. The inflatable bag 11 can be made of a thin mylar polymer or other polymer as desired and has a gondola 12 placed on the bottom thereof. The shape of the bag 11 includes a pair of stabilizer fins 13. A control box 15 has an antenna 14 attached thereto. The control box has a radio transmitter therein and has at least a pair of controls 16 and 17 positioned thereon and may also have batteries therein for powering the transmitter. The controls 16 and 17 may be electrical switches for switching the transmission of different frequencies on and off or may use potentiometers for transmitting a variable signal.

Figure 4:
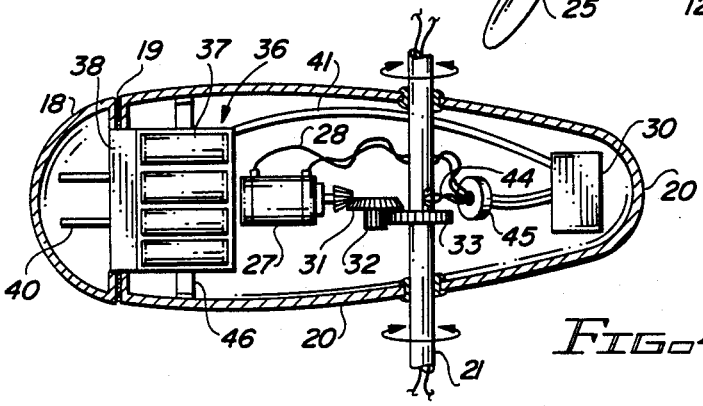
FIG. 4 is a sectional view taken through the gondola of FIGS. 1 through 3.

The transmitter 15 transmits through the antenna 14 to a receiver control box 30 in the gondola 12 as seen in FIG. 4. The battery pack 36 has a plurality of rechargeable NICAD batteries 37 mounted therein with a battery charger 38 positioned on the front thereof and having a pair of electrical plug prongs 40 protruding from the battery charger 38. The batteries 37 are connected through conductors 41 to the control box 30 to provide power to the receiver and to control relays which direct the DC voltage through the conductors 28 to the DC motor 27 to drive the motor in a forward and reverse direction in accordance with the voltage applied thereto. Similarly, conductors 44 run from the control box 30 through the harness 45 into the shaft 21 to control the DC motors 22 and 23 in a forward or reverse direction.

The gondola 12 is removable from container 11 by disengaging the hook and loop material attachment 34 and is removed with the battery pack 36 and charger 38. The battery charger 38 and battery pack 36 are held to the gondola by the brackets 46. The front of the gondola 18 can also be removed by disengaging the hook and loop fastener 19 to expose the electrical plug prongs 40 in the front of the gondola. The prongs 40 can be rapidly plugged into an electrical receptacle to operate the charger 38 to recharge the rechargeable batteries 37. The front 18 of the gondola 12 can then be reattached and the gondola reattached to the container 11 with the Velcro attachments for operation of the lighter-than-air toy 10. The shaft 21 is mounted in a pair of sleeves 24 in the gondola body 20 and can be rotated thereon. Each motor 22 and 23 can also be rotated on the shaft 20 and may be pressure fitted for rotation thereon under sufficient torque, so that once positioned it will stay in that position unless sufficient torque is placed on it to rotate the motor. The motor 22 has a propeller 25 thereon while the motor 23 has a propeller 26 mounted to the shaft thereof. The motors 22 and 23 are electric reversible DC motors which can be made to rotate the propellers 25 and 26 in a forward or reversible direction.

Similarly, the shaft 21 can be rotated to rotate both motors 22 and 23 simultaneously within the pressure sleeves 24 and then will maintain the position by the pressure from the sleeves 24 which may be made of a rubber or other material having sufficient frictional qualities to hold the shaft in position. Alternatively, a third electric motor 27 may be mounted inside the gondola 12 and connected to conductors 28 for driving in a forward or reverse direction an electric motor which drives a gear 31 which in turn drives a gear 32 and a gear 33 mounted to the shaft 21 so that the rotation of the shaft 21 can be remotely controlled from the control panel 15 to rotate in a forward or reverse direction, depending upon the direction of the current applied to the motor 27. Since batteries operate the control, positive or negative voltage can be applied to any particular wire with relay switches to actuate any particular motor in a forward or reversible direction. The gondola in this case, is supported with one portion of Velcro 34 attached to the inflatable bag 11, while the gondola has a section of Velcro 35 attached thereto for attaching the gondola directly to the inflatable bag 11. This allows the entire gondola 12 to be removed from the flexible container and placed on a different shaped toy if desired, or alternatively to replace the inflatable bag 11 if it should become damaged and to recharge the batteries when needed. The inflatable container 11 is made of a thin mylar which can become damaged if it becomes entangled against a sharp or pointed object. The inflatable container needs to be inflated prior to use since the helium used for inflating the toy tends to be lost over a period of time. A portable helium inflating tank of small size, which can be commercially purchased, is used for filling the containers before use.

It should be clear at this time that a remote controlled lighter-than-air toy has been provided but it should also be clear that the present invention is not limited to the forms shown which are to be considered illustrative rather than restrictive.

I claim:

1. A remote controlled lighter-than-air toy comprising:

an inflatable container having a predetermined shape for holding a lighter-than-air gas;

a gondola having front and rear portions and being removably attached to said inflatable container;

a shaft extending through said gondola and rotatable supported thereto;

a reversible electric motor attached to each end portion of said shaft, each electric motor having a propeller attached thereto for rotation upon actuation of the electric motor, each said electric motor and propellor being rotatable attached to said shaft;

a radio receiver located in said gondola and operatively coupled to said electric motors through a plurality of conductor wires;

a remote control box having a transmitter therein for transmitting to said radio receiver for remotely controlling each said electric motor separately; whereby said lighter-than-air toy can be remotely controlled with two propellers;

a rechargebable battery pack located in said gondola and connected to said receiver and to said electric motors for powering said receiver and electric motors;

a battery charger means connectable to an alternating electric power source and to said battery pack for recharging said battery pack, said battery charger means including a battery charger positioned in said gondola and having a pair of AC plug prongs protruding therefrom for insertion into an AC receptacle for recharging said batteries; and said gondola having a removable portion positioned over said battery charger pair of AC plug prongs, whereby said gondola can be positioned adjacent an AC receptacle and said battery charger prongs plugged thereinto.

2. A remote controlled lighter-than-air toy in accordance with claim 1 in which said gondola has a strip of hook and loop material attached thereto and said inflatable container has a strip of hook and loop material attached thereto for removably attaching said gondola to said inflatable container.

3. A remote controlled lighter-than-air toy in accordance with claim 1 in which said gondola removable portion is removably attached to said gondola with a hook and loop material.

4. A remote controlled lighter-than-air toy in accordance with claim 3 in which said gondola removable portion is the front portion of said gondola.

5. A remote controlled lighter-than-air toy in accordance with claim 4 in which said battery charger is attached to the inside of said gondola and has said plug prongs protruding to the front of said gondola whereby removing said removable gondola portion allows said prongs to protrude for insertion into a receptacle.

* * * * *